US006787986B2

(12) United States Patent
Murata et al.

(10) Patent No.: US 6,787,986 B2
(45) Date of Patent: Sep. 7, 2004

(54) DISPLAY APPARATUS WITH ELECTRON-EMITTING ELEMENTS

(75) Inventors: Hirotaka Murata, Fukaya (JP); Takashi Nishimura, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/443,763

(22) Filed: May 23, 2003

(65) Prior Publication Data

US 2003/0205965 A1 Nov. 6, 2003

Related U.S. Application Data

(63) Continuation of application No. PCT/JP01/10159, filed on Nov. 21, 2001.

(30) Foreign Application Priority Data

Nov. 24, 2000 (JP) ..... 2000-357989

(51) Int. Cl.[7] ..... H01J 1/62
(52) U.S. Cl. ..... 313/496; 313/495; 315/169.1
(58) Field of Search ..... 313/495, 496, 313/497, 422, 477 R, 479; 315/169.1, 169.3

(56) References Cited

U.S. PATENT DOCUMENTS 5,982,082 A * 11/1999 Janning ..... 313/336
6,215,243 B1 * 4/2001 Janning ..... 313/496
6,323,594 B1 * 11/2001 Janning ..... 313/495
6,566,804 B1 * 5/2003 Trujillo et al. ..... 313/495

FOREIGN PATENT DOCUMENTS

| | | | |
|---|---|---|---|
| EP | 0 739 029 A2 | 10/1996 | |
| JP | 5-166474 | 7/1993 | |
| JP | 2000251755 A * | 9/2000 | ..... H01J/29/28 |

* cited by examiner

*Primary Examiner*—Ashok Patel
*Assistant Examiner*—Karabi Guharay
(74) *Attorney, Agent, or Firm*—Oblon, Spivak, McClelland, Maier & Neustadt, P.C.

(57) ABSTRACT

A vacuum envelope of a display apparatus includes a rear plate, a face plate opposing the rear plate, and a side wall interposed between the rear and face plates. A phosphor screen is formed on the inner surface of the face plate. A plurality of electron-emitting elements are provide on the inner surface of the rear plate, to emit electrons to the phosphor screen. A reinforced glass plate is provided, opposing the outer surface of the face plate. A resistive layer is provided between the reinforced glass plate and the face plate. The resistive layer has a sheet resistance of 10 Ω/□ or more and is set at an anode potential.

8 Claims, 3 Drawing Sheets

DISPLAY APPARATUS WITH ELECTRON-EMITTING ELEMENTS

CROSS-REFERENCE TO RELATED APPLICATIONS

This is a Continuation Application of PCT application No. PCT/JP01/10159, filed Nov. 21, 2001, which was not published under PCT Article 21(2) in English.

This application is based upon and claims the benefit of priority from the prior Japanese Patent Application No. 2000-357989, filed Nov. 24, 2000, the entire contents of which are incorporated herein by reference.

BACKGROUND OF THE INVENTION

1. Field of the Invention

The present invention relates to a display apparatus. More particularly, the invention relates to a display apparatus that comprises a number of electron-emitting elements.

2. Description of the Related Art

In recent years, light, thin planar display apparatuses have been developed as next-generation displays. They comprise a phosphor screen and a number of electron-emitting elements (hereinafter referred to as "emitters") that oppose the phosphor screen. The emitters may be of the field-emission type or the surface-conduction type. Any display apparatus that comprises electron-emitting elements of field-emission type, used as emitters, is generally called "field emission display (hereinafter referred to as "FED"). Any display apparatus that comprises electron-emitting elements of surface- conduction type, used as emitters, is called "surface-conduction type, electron-emitting display (hereinafter referred to as "SED").

Generally, an FED has a face plate and a rear plate, which oppose each other and are spaced apart with a prescribed gap between them. The substrates are joined together at their peripheral edges, with a rectangular frame shaped side wall interposed between them. The substrates and the side wall constitute a vacuum envelope. A phosphor screen is formed on the inner surface of the face plate. A number of emitters are provided on the inner surface of the rear plate. The emitters are used as elements for emitting electrons that excite the phosphor, causing the phosphor to emit light. A plurality of support members are arranged between the rear plate and the face plate, preventing the substrates from collapsing due to the atmospheric pressure applied on the plates.

The rear plate is at a potential of about 0V. An anode voltage Va is applied to the phosphor screen. The electron beams emitted by the emitters are applied to the red, green and blue phosphors of the phosphor screen. Upon receiving the electrons, the phosphors emit light, whereby the FED displays an image.

In the FED, the gap between the front and rear plates can be reduced to a few millimeters or less. The FED can therefore be lighter and thinner than cathode-ray tubes (CRTs) that are used at present as TV displays and computer displays.

With the display apparatus thus structured, it is necessary to use phosphors of the same type as used in ordinary cathode-ray tubes and to set the anode voltage at several kilovolts or more, so that the apparatus may acquire practically useful characteristics. However, the gap between the front and rear plates cannot be so large, in view of the resolution, the characteristics of support members, the manufacturing ease, and the like. The gap should be about 1 to 2 mm. An intense electric field will inevitably develop between the front and rear plates, and discharge (dielectric breakdown) may occur between the plates.

If discharge takes place, the emitters and the phosphor screen may be broken or deteriorated. Discharge should not occur in the product because it would result in errors. Nonetheless, it is extremely difficult to prevent the discharge.

The discharge may be controlled, not prevented, so that the influence it imposes on the emitters may be negligibly small. This technical concept is similar to the technical concept which is widely applied in the field of CRTs and known as "soft flashing." This technique is to increase the resistance of the film on the inner surface of a CRT to reduce the discharge current. Thus, the technique can prevents the breakdown of the circuit incorporated in the tube even if discharge takes place.

In the FED and the SED, however, the phosphor screen acts as a discharge electrode, and thus, the above-mentioned technique cannot be employed, without any countermeasures.

BRIEF SUMMARY OF THE INVENTION

The present invention has been made in view of the foregoing, and its object is to provide a display apparatus in which, if discharge occurs, the discharge current can be controlled to prevent the emitters and phosphor screen from being broken or deteriorated.

To attain the object, a display apparatus according to an aspect of the invention comprises: a face plate having a phosphor screen formed on an inner surface of the face plate; a rear plate opposing the phosphor screen and having a plurality of electron-emitting elements which emit electrons toward the phosphor screen; a transparent insulating substrate opposing an outer surface of the face plate; and a resistive layer provided between the face plate and the insulating substrate.

In the display apparatus according to the aspect of the invention, it is desired that the resistive layer has a sheet resistance of 10 Ω/□ or more, and the resistive layer may comprise a transparent conductive film or may be formed of filler or the like.

In the display apparatus thus structured, the insulating substrate opposes the outer surface of the face plate and the anode voltage or a similar voltage is applied to the outer surface of the face plate, too. This can minimize the charge accumulated in the face plate, almost to zero. The insulating substrate indeed accumulates an electric charge. However, this charge cannot reach the discharging section unless it passes through the resistive layer, because the resistive layer is provided between the face plate and the reinforced glass plate. Hence, the discharge current can be controlled to prevent the emitters and phosphor screen from being broken and deteriorated.

Assume discharge occurs between the face plate and the rear plate. The magnitude of this discharge is determined by the charge accumulated in the capacitor comprising the front and rear plates. The capacitor is constituted by a capacitor C1 provided between the front and rear plate and a capacitor C2 defined between the inner and outer surfaces of the face plate. The capacitors C1 and C2 can be regarded as being connected in parallel to each other. If an aspect of the present invention is not applied, the voltage at the face plate will instantaneously become almost 0V. If this happens, most charge accumulated in C1 and C2 will become a discharge current.

In the display apparatus according to the embodiment of the invention, a potential difference between the inner and outer surfaces of the face plate is rendered zero, and C2 will generate no charge. Generally, C2 is far greater than C1 because a glass layer having permittivity of about 8 is inserted in C2. In order to make the apparatus light, it is desirable to reduce the thickness of the face plate. If the face plate is thin, however, C2 will increases. In view of this, it is very advantageous that the influence of C2 can be eliminated. Although the application of this invention cannot completely eliminate the influence of C1, the magnitude of discharge will greatly decrease. This is because C2 is much greater than C1.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

An embodiment of the invention, i.e., a display apparatus or an FED, will be described in detail with reference to the accompanying drawings.

Figure 1:
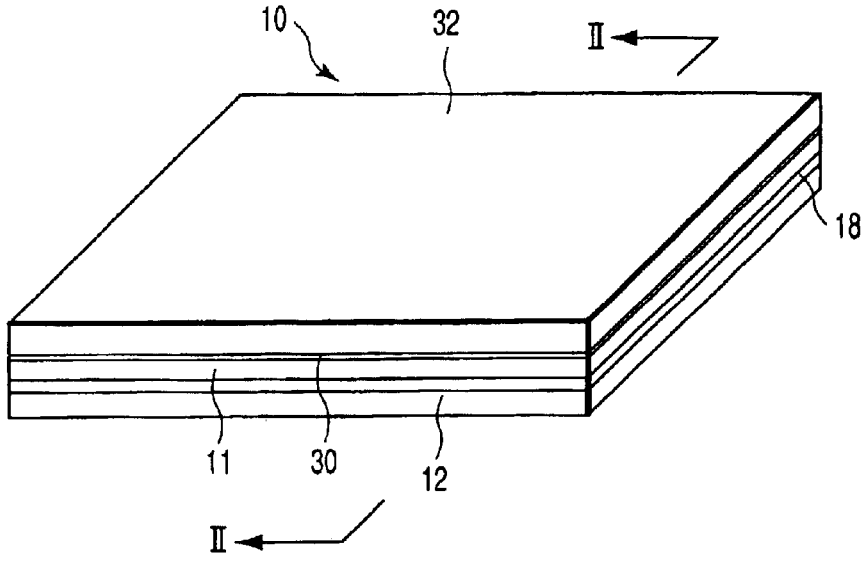
FIG. 1 is a perspective view of an FED according to an embodiment of this invention.
Figure 2:
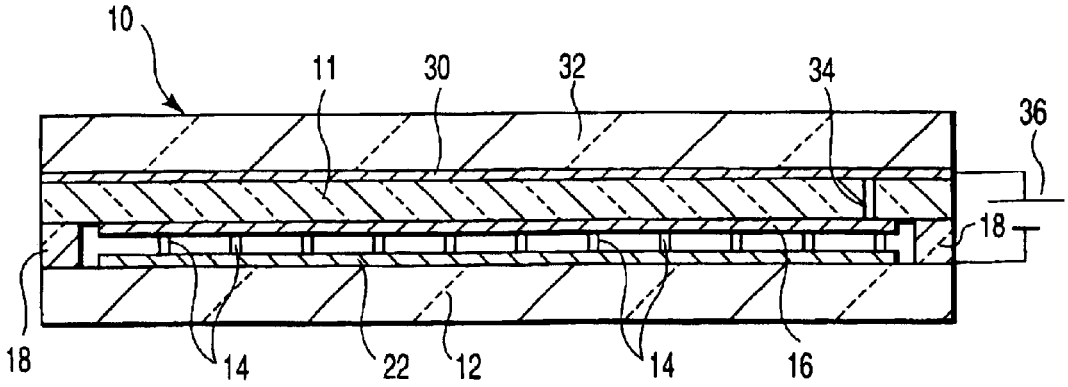
FIG. 2 is a cross-sectional view, taken along line II—II shown in FIG. 1.

As shown in FIGS. 1 and 2, the FED comprises a face plate 11 and a rear plate 12, each being a rectangular plate made of glass. The plates oppose each other, with a gap of 1 to 2 mm between them. The face plate 11 and rear plate 12 are joined together at their peripheral edges, with a rectangular frame shaped side wall 18 interposed between them. Thus, the plates and the side wall constitute a flat rectangular vacuum envelope 10 in which a vacuum is maintained.

In the vacuum envelope 10, a plurality of support members 14 are provided. The members 14 prevent the face plate 11 and rear plate 12 from collapsing due to the atmospheric pressure applied on the plates 11 and 12. The support members 14 extend parallel to the long sides of the envelope 10 and are spaced apart at a prescribed interval in the direction parallel to the short sides of the envelope 10.

Figure 3:
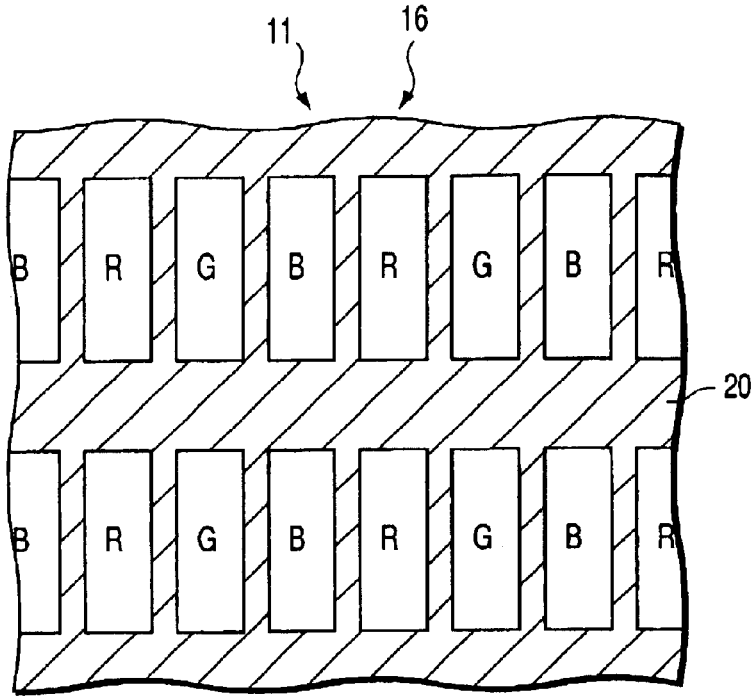
FIG. 3 is a plan view of a phosphor screen of the FED.

As seen from FIGS. 2 and 3, a phosphor screen 16 is formed on the inner surface of the face plate 11. The screen 16 includes red phosphor layers, green phosphor layers, blue phosphor layers and a light-absorbing black layer 20. The phosphor layers are arranged in rows and columns, forming a matrix. The support members 14 are located behind the light-absorbing black layer and concealed thereby. An aluminum layer (not shown) serving as a metal back is vapor-deposited on the phosphor screen 16.

Figure 4:
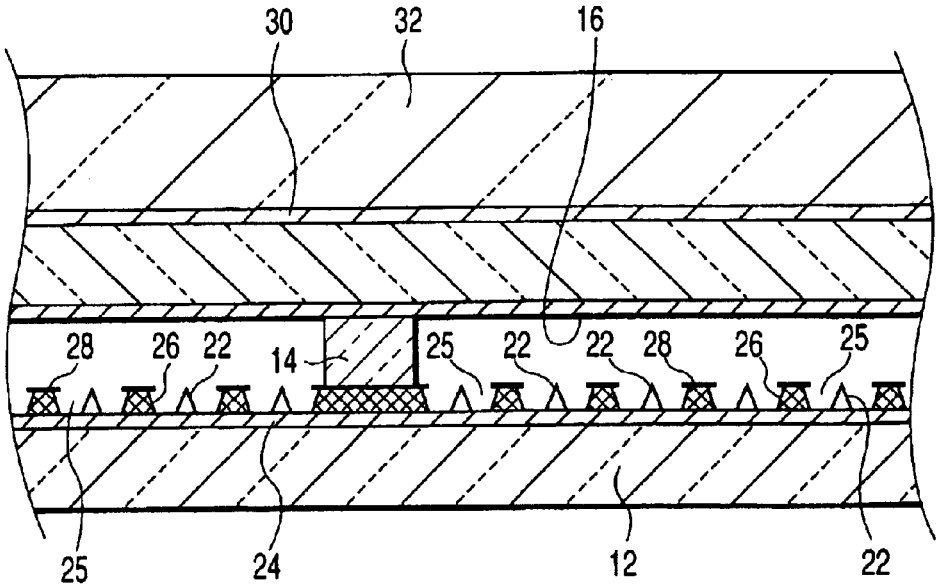
FIG. 4 is an enlarged cross-sectional view illustrating a part of the FED.

As FIG. 4 depicts, a number of electron-emitting elements 22 for emitting electron beams are provided on the inner surface of the rear plate 12. The elements 22 are sources of electrons that may excite the phosphor layers. The electron-emitting elements 22 are arranged in rows and columns, each aligned with one phosphor layer. More specifically, a cathode layer 24, i.e., a conductive layer, is formed on the inner surface of the rear plate 12, and a silicon dioxide film 26 having many cavities 25 is formed on the cathode layer 24. Gate electrodes 28 made of molybdenum, niobium, or the like are provided on the silicon dioxide film 26. The electron-emitting elements 22 that are shaped like a cone and formed of molybdenum or the like are provided in the cavities 25 and on the inner surface of the rear plate 12.

As shown in FIGS. 1, 2 and 4, a resistive layer 30 is formed on the entire outer surface of the face plate 11. A reinforced glass plate 32 serving as a transparent insulating substrate is mounted on the resistive layer 30. The plate 32 has almost the same size as the face plate 11, as viewed from above.

The resistive layer 30 is a transparent conductive film formed on the outer surface of the face plate 11. It is about 1 to 10 $\mu$m thick and has sheet resistance of 10 Ω/□ or more. The transparent conductive film may be formed by a known process such as sputtering, vapor deposition or spin-coating. The reinforced glass plate 32 is, for example, 2.8 mm thick and is fixed to the resistive layer 30 with epoxy resin or the like. It reinforces the face plate 11. To prevent interfacial reflection, it is preferable that the resin used has a refractive index as close to that of the glass as possible.

A part of the resistive layer 30 is electrically connected to the phosphor screen 16 through a through hole 34 formed in the face plate 11. The through hole 34, which serves to a connecting portion, is located near the side wall 18. A power supply 36, or a potential-applying unit, is connected to and provided between the conductive cathode layer 24 and the resistive layer 30. The power supply 36 applies an anode potential to the resistive layer 30. The power supply 36 has its high-voltage terminal connected to the resistive layer 30, at a position near the through hole 34. The resistance between the power supply 36 and the through hole 34 is of such a value that a voltage drop induced by a beam current can be negligibly small.

In the FED thus structured, a video signal is input to the electron-emitting elements 22 and the gate electrodes 28 which are arranged to form a simple matrix. A gate voltage of +20V is applied when the luminance is the highest, with the electron-emitting elements 22 considered as reference. A voltage of +10 kV is applied to the phosphor screen 16. The electron beams emitted from the elements 22 are modulated with the gate voltage. The beams thus modulated excite the phosphor layers of the screen 16. The phosphor layers emit light, whereby the FED displays an image.

In the FED thus structured, the reinforced glass plate 32 opposes the outer surface of the face plate 11, with the resistive layer 30 interposed between the plate 32 and the plate 11, and the anode voltage or a voltage close thereto is applied to the outer surface of the face plate 11, too. This minimizes the charge accumulated in the face plate 11 to almost zero (0). The reinforced glass plate 32 indeed accumulates an electric charge. However, since the resistive layer 30 is provided between the face plate 11 and the reinforced glass plate 32, this charge in the reinforced glass plate 32 cannot reach the discharging section unless it passes through the resistive layer 30 and the hole 34, as discharge is generated. The discharge current is therefore controlled. This prevents the electron-emitting elements 22 and the phosphor screen 16 from being broken and deteriorated.

To determine the relation between the resistance of the resistive layer and the effect of controlling the damage caused by discharge, the inventors hereof conducted experiments on FEDs that have a 10-inch screen and differ in resistance. The results of the experiments showed that some advantage can be attained if the resistance is 10 Ω/□ or greater. The results also showed that the resistance may be $10^3$ Ω/□ or greater to achieve a remarkable advantage.

If the present invention is not applied, the lowest resistance of a discharge arc may be measured to be about $10^2$ Ω. The resistance should be significantly greater than this value to control the discharge current. In view of this, too, the results are based on good reason.

The FEDs subjected to the experiments are of the same dimensions. Generally, the resistance of a discharge arc does not greatly depend on the dimensions of the FED. The results can therefore be considered true for any FEDs, regardless of the sizes of FEDs. Hence, the resistive layer has a sheet resistance of 10 Ω/□ or greater in the present invention.

The reinforced glass plate 32 serving as the insulating substrate is used to achieve this advantage also serves to reinforce the face plate and shield X rays. Hence, the display apparatus can be strong to impacts and can control X rays. Therefore, the range of thickness and the range of material are broad for the face plate. This is another advantage of the present embodiment.

In the embodiment described above, the resistive layer 30 is a transparent conductive film. Instead, the resistive layer 30 may be filler applied in the gap between the face plate 11 and the reinforced glass plate 32. Further, the transparent conductive layer may be formed on the insulating substrate, not on the entire outer surface of the face plate as described above.

Figure 5:
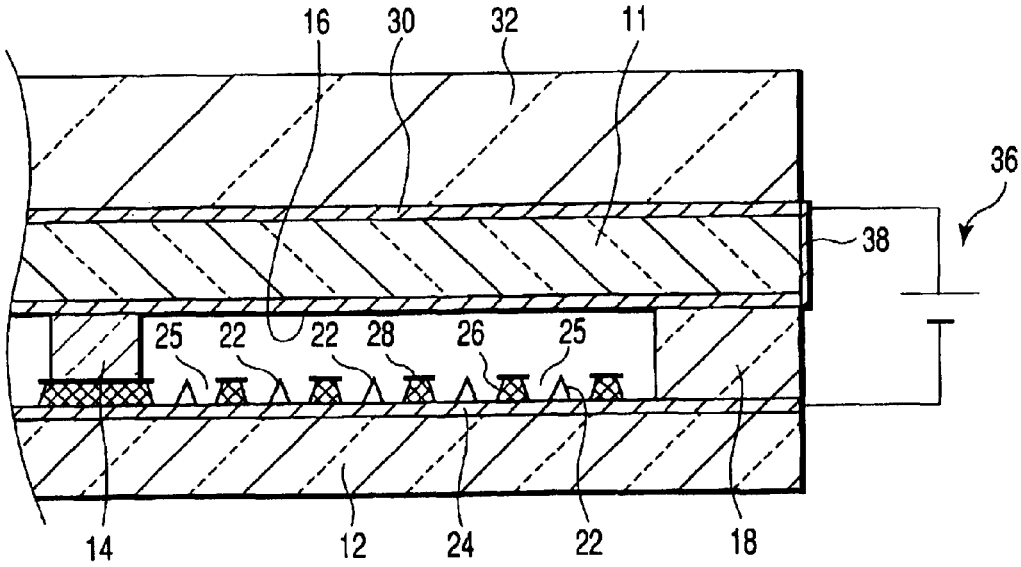
FIG. 5 is an enlarged cross-sectional view depicting a part of a FED according to a modification of the invention.

The connecting portion configured to electrically connect the resistive layer 30 to the phosphor screen 16 is not limited to the through hole, but it may be a conductive film 38 formed on one side of the face plate 11, as shown in FIG. 5.

The resistive layer 30 may not be electrically connected to the phosphor screen 16. Rather, the layer 30 and the screen 16 may be set at potentials the difference between which is smaller than the difference between the potentials inherent in the layer 30 and substrate 16.

The resistive layer need not have a uniform value over the entire surface. The advantage of this invention can be attained only if at least one part of the layer has sheet resistance of 10 Ω/□ or more. Needless to say, it is desired that the resistive layer has sheet resistance of 10 Ω/□ or more over the entire surface. The sheet resistance may be lower than 10 Ω/□ at some parts of the layer.

In the embodiment described above, a transparent insulating substrate opposes the entire outer surface of the face plate. Instead, a transparent insulating substrate that is smaller than the face plate may be arranged, opposing the face plate. In this case, the edge parts of the face plate may be covered with any insulating member other than the insulating substrate.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention can be applied not only to FEDs, but also SEDs having electron-emitting elements of surface conduction type and any other types of planar display apparatuses. The sizes and materials of the components are not limited to those specified above. They can be changed, if necessary.

What is claimed is:

1. A display apparatus comprising:

a face plate having a phosphor screen formed on an inner surface of the face plate;

a rear plate opposing the phosphor screen and having a plurality of electron-emitting elements which emit electrons toward the phosphor screen;

a transparent insulating substrate opposing an outer surface of the face plate; and a resistive layer provided between the face plate and the insulating substrate; and a potential difference between the phosphor screen and the resistive layer is smaller than a potential difference between the resistive layer and the insulating substrate.

2. The display apparatus according to claim 1, wherein the resistive layer has a sheet resistance of at least 10Ω/□.

3. The display apparatus according to claim 1, wherein the resistive layer includes a transparent conductive film.

4. The display apparatus according to claim 1, wherein the resistive layer is formed of filler applied in a gap between the face plate and the insulating substrate.

5. The display apparatus according to claim 1, wherein the face plate has a connecting section which electrically connects the resistive layer to the phosphor screen.

6. The display apparatus according to claim 5, further comprising a potential-applying section which is connected to the resistive layer at a position near the connection section and which applies anode potential to the resistive layer.

7. The display apparatus according to claim 1, wherein the resistive layer and the phosphor screen are electrically connected through a through hole formed in the face plate.

8. The display apparatus according to claim 1, wherein the resistive layer and the phosphor screen are electrically connected through a conducting part formed on a side of the face plate.

* * * * *